United States Patent [19]

Bell

[11] Patent Number: 4,774,970

[45] Date of Patent: Oct. 4, 1988

[54] SMOKING APPLIANCE AND METHOD

[76] Inventor: Douglas W. Bell, 8883 A Salmon Falls, Sacramento, Calif. 95818

[21] Appl. No.: 940,735

[22] Filed: Dec. 11, 1986

[51] Int. Cl.[4] ..... A24F 1/02

[52] U.S. Cl. ..... 131/175; 131/185; 131/194; 131/195

[58] Field of Search ..... 131/175, 185, 194, 195, 131/329, 349, 196, 197

[56] References Cited

U.S. PATENT DOCUMENTS 2,335,786 11/1943 Mullica ..... 131/196

2,429,808 10/1947 Downing ..... 131/197

4,572,217 2/1986 Newmann et al. ..... 131/349

*Primary Examiner*—V. Millin

*Attorney, Agent, or Firm*—Bernhard Kreten

[57] ABSTRACT

A smoker's appliance including a passageway upstream from the site of the tobacco, a passageway downstream thereof and means for elevating the upstream passageway's temperature to provide superheated area to the site of combustion. Downstream from the site of combustion, cooling occurs to precipitate and condense smoke fractions unwanted by the user.

17 Claims, 1 Drawing Sheet

SMOKING APPLIANCE AND METHOD

FIELD OF THE INVENTION

The following invention relates generally to appliances for smokers and methods for its use. More specifically, the device delivers air at super heated temperatures to the site of tobacco combustion to cause chemical reactions including isomerization, oxidation and catalysis. Downstream therefrom cooling is effected so that consituents contained within the smoke have undergone a change in form and are readily deposited on a section between the user and the tobacco site for cleansing the smoke by precipitation prior to inhaling.

BACKGROUND OF THE INVENTION

Currently, a controversy exists with respect to the rights of smokers and non-smokers sharing the same useable air. A distinction should be made with respect to the smoke from a cigarette which occurs when the cigarette is lit but not being used (smoked) and when one is inhaling a cigarette. Frequently, people who smoke from habit will light a cigarette and personally consume a relatively small portion of the cigarette although the cigarette continues to burn. Indeed, commercial cigarettes are specially treated so as to insure uniform continuous burning without being smoked. It is posited that if a cigarette were allowed to go out when not in actual use, the total volume of smoke entering a given air space would be substantially reduced.

Other problems exist with respect to the smoke that is discharged from a cigarette. It is known, for example, that tars and nicotines are present in cigarettes and these constituants are capable of separation to some degree from the smoke through filtration. Nonetheless, pure mechanical filters are not totally efficient in removing certain constituents from the tobacco smoke.

The following patents reflect the state of the art of which applicant is aware and is tendered with the expressed view of discharging his duty to disclose prior art. Their teachings do not appear to preclude patentability.

| | | |
|---|---|---|
| 2,335,786 | Mullica | November 30, 1943 |
| 2,104,266 | McCormick | January 4, 1938 |
| 959,043 | Barger | May 24, 1910 |
| 711,691 | Barger | October 21, 1902 |
| 281,573 | Smith | July 17, 1883 |
| 140,360 | Gedies | July 1, 1873 |
| 3,100,493 | Rundle | August 13, 1963 |
| 573,064 | Vester | December 15, 1896 |
| 3,303,849 | Arnold, et al | October 4, 1965 |
| 43,906 | Foley | August 23, 1864 |
| 949,043 | Barger | May 24, 1910 |
| 4,289,149 | Kyriakou | September 15, 1981 |
| 1,661,895 | Hilshansky | March 6, 1928 |
| 1,840 | Rowe | December 27, 1864 |
| 3,709,233 | Stelitano | January 9, 1973 |
| 851,773 | Pfortner | April 30, 1907 |

It is clear that none of these patents teach singularly or in any conceivable combination that which is the essence of the instant invention as set forth in the claims hereinafter.

For example, the patent to Pfortner teaches the use of a smoking device where the smoke from a tobacco pipe goes through a tortuous path downstream from the point of ignition prior to being inhaled.

Stelitano teaches the use of a tobacco pipe in which an open end of the bowl is first loaded with tobacco.

While the tobacco is lit by a match or lighter through a small opening on the side of the bowl, the side opening is provided with a sliding cover which is closed thereby preventing spillage of ignited embers.

The remaining citations show the state of the art further. It is clear that none of the citations reflect the teaching of preheating the air prior to combustion.

SUMMARY OF THE INVENTION

More particularly, the instant invention is directed to an instrumentality which limits the smoke exhausted to the ambient air only that which has been used by the smoker in inhaling.

In addition, the instrumentality according to the present invention preheats the air prior to combustion with the tobacco and thereafter cools the smoke downstream from the tobacco source so that precipitation and extraction of impurities and heavy elements will be effected.

Specifically, a tubular section upstream of the source of tobacco is provided with a hole at the end of the tubular section remote from the tobacco source, and serves to deliver a flame down the tubular section. Once the tobacco has been lit, this passage way at the site of lighting is occluded, and air is admitted near the same lighting hole but on an annular outer wall of the tubular section. Air passes through a tortuous path between inner and outer annular cylinders and is preheated by the flame's earlier presence when igniting the tobacco. Thus, the air used to support combustion is preheated substantially and prior to encountering the tobacco.

Downstream from the source of tobacco, a second tubular section is provided which has not been preheated by the flame and communicates the tobacco smoke with the smoker. Downstream section serves to decrease the temperature of the smoke causing substantial precipitation of nicotine, heavy tars, and other impurities commonly found in tobacco or tobacco paper. When the device is not being smoked it will not continue to allow the tobacco to burn, thus eliminating unused smoke wafting into the environment.

OBJECTS OF THE INVENTION

Accordingly, it is the primary object of this invention to provide a device which can improve the constituents of the tobacco smoke inhaled by a person.

It is yet a further object of this invention to provide a device as characterized above which precludes the admission of smoke into the atmosphere except when being used by a smoker and then only when the smoker exhales.

It is a further object of the present invention to provide a device as characterized above which preheats the air prior to contact with the tobacco source thereby elevating the combustion temperature and isomerizing the components in the tobacco.

It is yet a further object of this invention to provide a device as characterized above wherein the elevated incoming air temperature causes catalysis when in contact with the tobacco to be smoked.

It is yet a further object of the invention to provide a device as characterized above which causes improved oxidation when the air contacts the tobacco source.

It is yet a further object of this invention to provide a device as characterized above which cools the smoke downstream from the point of ignition to accelerate precipitation of contaminents and unwanted components in the smoke.

It is yet a further object of this invention to provide a device which is easily transportable, safe to use and relatively inexpensive to manufacture, benefitting from economies of scale by mass production techniques.

These and other objects will be made manifest when considering the following detailed specification when taken in conjunction with the appended drawing figures.

DESCRIPTION OF THE DRAWING FIGURES

BRIEF DESCRIPTION OF THE PREFERRED EMBODIMENT

Figure 1:
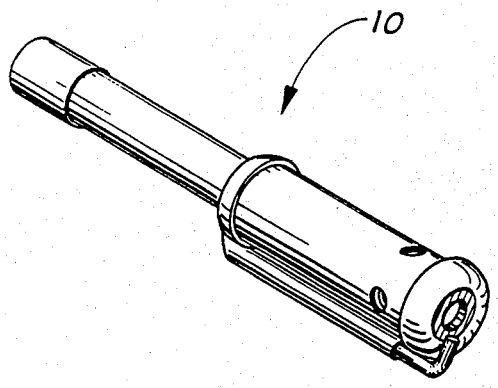
FIG. 1 is a perspective view of the apparatus according to the present invention.

Referring to the drawings now, wherein like reference numerals refer to like parts throughout the various drawing figures, reference numeral 10 is directed to the smoking appliance according to the present invention.

Figure 2:
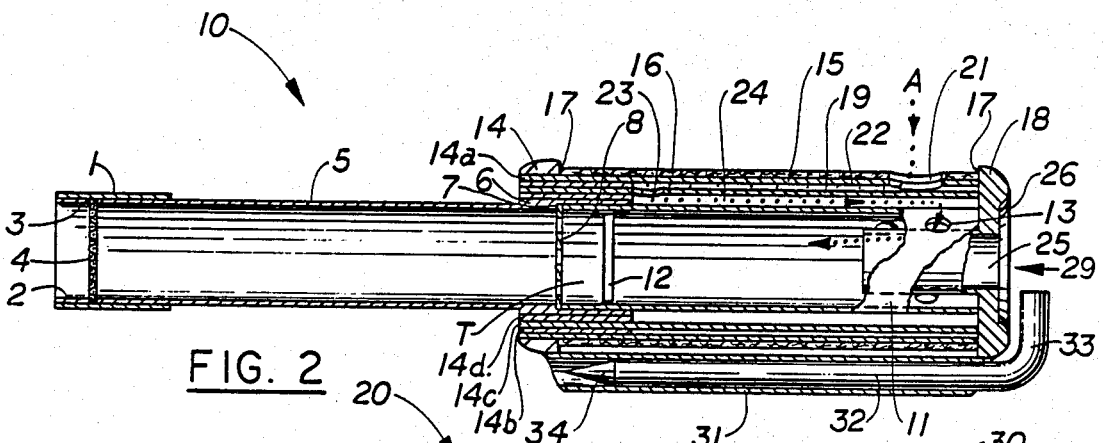
FIG. 2 is a sectional view of that which is shown in FIG. 1 taken along its longitudinal axis.
Figure 3:
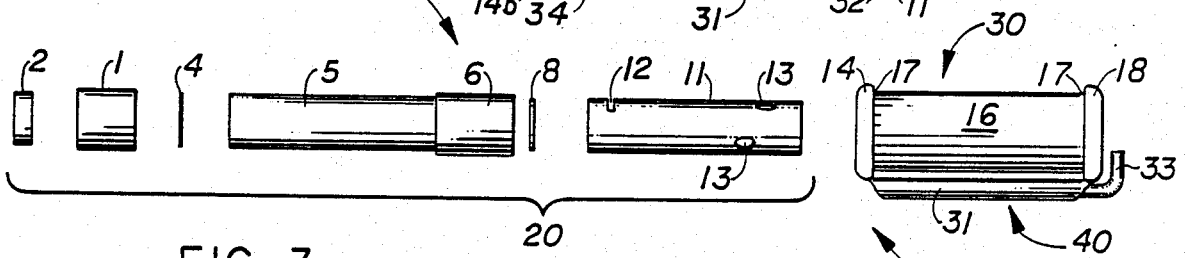
FIG. 3 is an exploded parts view of that which is shown in FIGS. 1 and 2.

More particularly, and with reference to FIGS. 2 and 3, the smoker's appliance 10 includes an area for receiving tobacco "T", an area 30 upstream from the tobacco "T" and an area 20 downstream from the tobacco.

With respect to the area 20 downstream, a mouth piece 1 is provided having an inner sleeve 2 concentrically disposed and frictionally engaged within the mouth piece 1 so as to provide an annular shoulder 3. This shoulder 3 supports a screen 4 which can serve as a spark arrester and is preferrably formed from a rather fine mesh silver material. At the outset, it should be noted that material which is cojoined uses silver solder because its purity and relatively high vaporization temperature will not introduce any unwanted constituants into the smoke. The mouth piece 1 frictionally engages a brass passageway 5 which fixes the screen 4 against the shoulder 3 of the mouthpiece 1. This brass passageway 5 is exposed to the air and serves as a collection area for unwanted smoke constituants, by cooling the smoke and precipitating the unwanted constituants on a surface thereof. An end 6 of the brass passageway 5 remote from the mouthpiece 1 is belled outwardly providing a shoulder 7 on an interior surface thereof which serves as a stop for a second silver screen 8, the screen 8 embodied as a silver disk provided with a plurality of apertures therethrough. Tobacco "T" can be placed adjacent the apertured silver disk 8 and is circumscribed by the bell section 6.

The portion of the appliance 10 which defines an upstream area 30 includes a brass cylinder 11 serving as an upstream passageway which includes a notch 12 disposed adjacent the end of the brass passageway 11 near the bell section 6. As shown in FIG. 2, the upstream brass passageway 11 frictionally engages an inner surface of the belled section 6 and the tobacco "T" is preferably placed between the silver disk 8 and past the notch 12.

If the device were to be used as thus described, a flame administered at an end of the upstream passageway 11 remote from the tobacco plug "T" would heat the brass upstream passageway 11, ignite the tobacco plug "T" and pass smoke downstream to the brass passageway 5 where cooling would occur due to the difference in temperatures based on the remoteness of the flame from the passageway 5. Note the presence of openings 13 on the upstream passageway 11 adjacent the end to be fired. The relevance of these openings 13 will now be explored when considering the effect a cap 40 has when placed over the upstream passage 11.

The cap 40 includes a non-heat conductive end flange 14 supported by an end **14*a* of a thin brass tube 15 defining an outer wall of cap 40. The free end of tube 15 carries an annular flange 18. Shoulders 17 are provided at both ends of the cap 40 where tube 15 connects to flanges 14 and 18. A decorative outer layer of material 16 circumscribes the tube 15. The decorative material 16** can be embodied as leather, plastic or any other material to provide a distinctive smoker's appliance.

Parallel to and concentrically disposed within the sleeve-like tube 15, a second annular tube 19 is provided having a free end **14*c* adjacent the flange 14. Tube 19 has a remote end attached to the annular flange 18. An opening 21 passing through the decorative material 16 and one end of tube 15 as well as an opening 23 provided on an opposite end of the annular tube 19 defines a first passageway 22 and a second passageway 24 to allow a secondary source of air to pass therebeyond. The tubes 15 and 19 are held in spaced relation from each other by spacers 14*b* and 14*d* which are tubular and of lesser length than tubes 14 and 19. Thus FIG. 2 shows that below flange 15 in order, there is: Tube 15's end 14*a*, spacer 14*b*, tube 19's free end 14*c*, spacer 14*d* and belled end 6**. The arrow "A" connotes the passageway of the secondary air.

Opening 29 denotes the primary passageway for air disposed on a sleeve 25 extending through an end wall of the annular flange 18. Note the sleeve 25 includes a shoulder 26 which rests upon a recessed portion of the annular cap 18.

In use and operation, a lighter or other source of flame is administered to the primary air opening 29 which allows a flame to pass beyond the sleeve 25 into the upstream passageway 11, ultimately igniting the plug of tobacco "T". In the process, however, the passageway 11 along with annular tube 19 is heated by the presence of a flame, superheating these walls. Once the tobacco is ignited, the primary air opening 29 is blocked off and the secondary air passageway 21, 22, 23, 24 and 13 are enabled. This allows air to pass through in the direction of the arrow A. This heat transfer elevates the air temperature which supports combustion and causes elevated burning temperatures at the tobacco plug "T". These elevated temperatures isomerize, oxidize and catalyze the tobacco "T", changing the composition of the smoke for subsequent processing downstream.

The downstream section 5, exposed to ambient air represents an opportunity for the smoke passing therethrough to experience relatively rapid cooling, causing condensation and precipitation of some smoke constituents, such as tar, nicotine and other constituents commonly found in cigarettes. These deposits are collected on the inner surface of the brass downstream passageway 5. Purified smoke then passes beyond the mouthpiece 1 to the user.

It should be clear that due to the geometrical design thus far explored, there is not enough ambient air surrounding the tobacco plug "T" to support combustion in the absence of the pressure differential caused by inhaling. Thus, the tobacco has a tendency to not burn when the appliance is not used. This in itself eliminates at major portion of the smoke which normally enters the environment.

In addition, however, the initial preheating of the air coupled with the rapid cooling of the smoke tends to cleanse the smoke making the products of combustion relatively more clean when being inhaled and therefore less laden with impurities when the smoker exhales.

Other features of the smoker's appliance 10 can now be explored. For example, FIGS. 1, 2, and 3 show a sleeve 31 extending between flange the extremities (18 and 14) of the cap 40. This sleeve 31 slidably supports an "L" shaped cleaning tool having an elongate section 32 and a short end 33. The cleaning tool has a pointed end 34 remote from the short end 33. The pointed end 34 helps to remove the plug of tobacco "T" when the device is partially disassembled. It is to be noted that when the downstream passageway 5 is removed from the upstream passageway 11, the area for receiving the plug of tobacco "T" is exposed and the cleaning tool can readily access the tobacco "T" for removal.

The notch 12 has a width substantially the thickness of disk 8. When the disk 8 is to be cleaned, it is placed in the notch and receives a flame which burns the disk 8 clean by charring the tars and other impurities.

Figure 4:
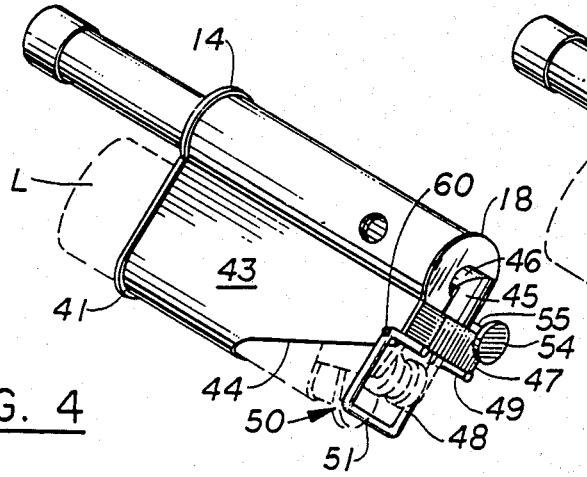
FIG. 4 is a perspective view of the apparatus according to a second form of the present invention.
Figure 5:
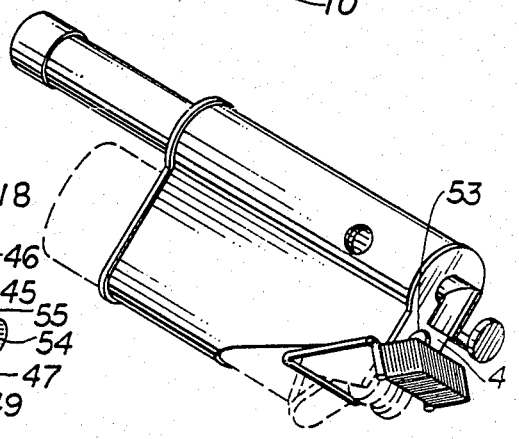
FIG. 5 is a perspective view of FIG. 4 shown in a second, deployed position.

FIGS. 4 and 5 show another alternative where a lighter is integrally contained with the smokers appliance 10. In this embodiment, the flanges 14, 18 of the cap 40 support two ears 41 and 42 respectively. Ear 42 has an opening 44 to receive a conventional gas lighter "L" as shown. The lighter "L" is captured between the two ears 41 and 42 by means of a complimentally formed sheath 43. The opening 44 is provided to allow the appliance user access to the lighter's enabling mechanism, commonly a striker wheel or flint and a gas valve operator. Flame coming from the lighter "L" communicates with an L-shaped passageway having a section 45 in communication with the fire outlet of the lighter "L" and another passageway 46 aligned with the longitudinal axis of the appliance 10. Thus, fire is admitted to the primary air opening 29 in a convenient manner. Note that section 45 is blocked off by a plug 47 which moves between the two positions of FIGS. 4 and 5. Plug 47 is supported and moved by a U shaped bracket 50 having a bight portion 51 and two legs 48. Free ends of the legs 48 are pivoted at pivot pin 60 to sheath 43 and include legs 49 to support the plug. When the lighter is used (FIG. 5), the flame goes through the opening 53 of ear 42, and the plug 47 is removed in the same motion which enables the lighter because the bracket 50 surrounds the lighter's gas valve and striker.

Note the cleaning tool shaft 55 of FIGS. 4 and 5 is modified. The head 54 of shaft 55 is offset, like a cam to lock the plug 47.

Having thus described the invention, it should be apparent that numerous structural modifications and adaptations may be resorted to without departing from the scope and fair meaning of the invention as detailed herein above and as defined hereinbelow by the claims.

I claim:

1. A smoker's appliance for purifying tobacco smoke by isomerizing, oxidizing, and catalyzing tobacco smoke before inhaling and for minimizing smoke expelled to the ambient surroundings, comprising, in combination:

a nonflammable container having an inlet for lighting tobacco and a smoke outlet, a medial container portion having means for receiving a charge of the tobacco to be smoked, and means attached to said smoker's appliance for simultaneously lighting said tobacco and heating an element in said appliance, said element being located in a passageway in said appliance so that when heated will substantially preheat air employed for combustion prior to the air encountering the tobacco;

said combustion air is effectively preheated by said element to a temperature that enhance isomerizing of tobacco smoke.

2. The device of claim 1 wherein said passageway extending between the tobacco and said inlet is an upstream passageway and said preheating means includes:

a cap placed over said upstream passageway including first and second air paths, said first air path axially aligned with said upstream passageway and receiving a flame thereat, said second passageway formed as a tortuous path whereby air meanders through the path and is preheated by the earlier presence of the flame adjacent thereto.

3. The device of claim 2 wherein said tortuous path is formed from a plurality of concentrically disposed annular sleeves having alternate ends provided with openings so that air meanders therethrough, said sleeves formed from heat conductive material whereby presence of the flame heats said path.

4. The device of claim 3 wherein said concentric annular sleeves are supported at one end and spaced from each other by a series of short spacer sleeves interposed between adjacent heat conductive sleeves.

5. The device of claim 4 wherein a downstream passageway is provided between the tobacco and an outlet for receiving smoke, said passageway downstream is exposed to ambient air for subsequent cooling of the smoke.

6. The device of claim 5 wherein said cap has flanges to support a cleaning tool carried within a sleeve, said cap and said upstream and downstream passages are separable so that said cleaning tool can remove used tobacco, and spark arrester means placed within said downstream passageway to assure tobacco when lit will not pass to the person inhaling the smoke.

7. A device for minimizing the amount of secondary smoke from tobacco expelled in the environment by a smoker and prescrubbing the smoke prior to inhaling comprising, in combination:

a nonflammable container having an upstream inlet for lighting the tobacco and a downstream smoke outlet, a medial container portion having means for receiving a charge of the tobacco to be smoked and thereby defining upstream and downstream passageways, said downstream passageway formed from heat conductive material and interposed between said outlet and the tobacco having plural spark arresting means disposed therein to allow passage of smoke but not burning embers, said downstream passageway coacting with ambient air to cool the smoke and precipitate unwanted smoke fractions on an inner surface of said downstream passageway, thereby prescrubbing the smoke prior to inhaling, and means for depriving the tobacco of oxygen from said upstream passageway when said device is not being inhaled thereby extinguishing the tobacco.

8. The device of claim 7 wherein said an upstream passageway extending betweena the tobacco and said inlet includes preheating means comprising:

a cap placed over said upstream passageway including first and second air paths, said first air path axially aligned with said upstream passageway and receiving a flame thereat, said second air path formed as a tortuous path and concentric to said first path whereby air meanders through the path and is preheated by the earlier presence of the flame adjacent along said first air path.

9. The device of claim 8 wherein said tortuous path is formed from a plurality of concentrically disposed annular sleeves having alternate ends provided with openings so that air meanders therethrough, said sleeves formed from heat conductive materials whereby presence of the flame heats said path.

10. The device of claim 9 wherein said concentric annular sleeves are supported at one end and spaced from each other by a series of short spacer sleeves interposed between adjacent heat conductive sleeves.

11. The device of claim 10 wherein said means for depriving the tobacco of oxygen includes a plug on said first air inlet remote from the site of tobacco combustion by said passageways said upstream and said downstream to negate the effect of any ambient air currents.

12. The device of claim 10 wherein said flanges support first and second ears and connected therebetween a sheath dimensioned to receive a lighter and means for synchronizing the use of the lighter with automatic means for opening and closing said primary air inlet.

13. The device of claim 12 wherein said air inlet includes an "L" shaped passageway having an open end directed towards the lighter, and a plug removeably placed between the lighter and said inlet.

14. The device of claim 13 wherein a bracket is attached to said plug having substantially "U" shaped configuration and pivoted to said sheath, said bracket having a pair of upstanding legs which carries said plug and said "U" shaped portion of said bracket circumscribes an operative valve on the lighter.

15. The device of claim 14 wherein a cleaning tool is provided in a sleeve carried on said device and includes a shaft and a shaft head offset from the geometrical center of said shaft to serve as a cam whereby said shaft head can overly said plug to lock the lighter.

16. A method for purifying and reducing the amount of tobacco smoke exhaled in the environment, comprising, in combination:

placing a plug of tobacco in a smoking chamber, preheating combustion air upstream from the tobacco plug, igniting the tobacco plug, and cooling the tobacco smoke thus formed downstream from the plug prior to receiving the smoke.

17. The method of claim 16 including providing first and second air inlets, and preheating a tortuous path associated with said second inlet by administering a flame to said first inlet and after igniting the tobacco, disabling said first inlet thereby relying on said second air passageway.

* * * * *